US005502857A

United States Patent [19]

Jubinville

[11] Patent Number: 5,502,857

[45] Date of Patent: Apr. 2, 1996

[54] SCRAPER DEVICE FOR A BROOM

[76] Inventor: Gisele Y. Jubinville, R.R. #2, St. Albert, Alberta, Canada, T8N 1M9

[21] Appl. No.: 320,654

[22] Filed: Oct. 11, 1994

Related U.S. Application Data

[63] Continuation-in-part of Ser. No. 237,020, May 2, 1994.

[30] Foreign Application Priority Data

Sep. 23, 1994 [CA] Canada ..... 2133060

[51] Int. Cl.[6] ..... A47L 13/12

[52] U.S. Cl. ..... 15/111; 15/236.01

[58] Field of Search ..... 15/111, 236.01

[56] References Cited

U.S. PATENT DOCUMENTS

| | | | |
|---|---|---|---|
| 1,922,998 | 8/1893 | Williams . | |
| 2,163,979 | 6/1939 | Judson . | |
| 2,335,503 | 11/1943 | Gasper . | |
| 2,666,221 | 1/1954 | Stepper . | |
| 2,687,542 | 8/1954 | Turausky . | |
| 2,741,788 | 4/1956 | Shey . | |
| 2,815,990 | 12/1957 | McCrink . | |
| 2,867,827 | 1/1959 | Gantz . | |
| 3,084,369 | 4/1963 | Hawkins . | |
| 3,487,491 | 1/1970 | Dunn . | |
| 4,785,489 | 11/1988 | Van Doehren . | |
| 5,161,772 | 11/1992 | Diresta et al. | 15/111 |
| 5,309,654 | 5/1994 | Mathis . | |

FOREIGN PATENT DOCUMENTS

| | | |
|---|---|---|
| 0451027 | 10/1991 | European Pat. Off. . |
| 1030474 | 3/1953 | France . |
| 2150015 | 6/1985 | United Kingdom . |

*Primary Examiner*—Frankie L. Stinson
*Assistant Examiner*—Randall E. Chin
*Attorney, Agent, or Firm*—Beveridge, DeGrandi, Weilacher & Young

[57] ABSTRACT

A scraper device for attachment to a broom of the type having a head and a handle, the handle having a lower end for mounting to the head. The scraper device is comprised of a blade carrying member, having an upper end and a lower end, for attaching to the broom in a position such that the upper end of the blade carrying member abuts against the handle and the blade carrying member extends downwards and forwards over the head. As well, the scraper device includes means for attaching the blade carrying member to the broom when the blade carrying member is positioned for attachment to the broom so that the blade carrying member is secured to the broom and movement of the scraper device relative to the handle is restricted. Further, a scraper blade is located along the lower end of the blade carrying member so that debris may be scraped from a surface by the scraper device when the orientation of the broom is reversed from that normally used for sweeping. Finally, the scraper device may include first means, associated with the blade carrying member, for bracing the handle and supporting the blade carrying member when the blade carrying member is attached to the broom.

31 Claims, 5 Drawing Sheets

SCRAPER DEVICE FOR A BROOM

This application is a continuation-in-part application of U.S. patent application Ser. No. 08/237,020, filed May 2, 1994, now pending.

TECHNICAL FIELD

The present invention relates to a scraper device for attachment to a broom.

BACKGROUND ART

Conventional push brooms are used for sweeping shop floors, public buildings, garden patios, roads, sidewalks, etc. Often the push broom encounters materials such as mud, snow, ice, chewing gum, and other debris which stick to the surface being swept. In such circumstances, the sweeping action of the push broom alone is insufficient to free the sticking materials. As a result, the user of the push broom may reverse the broom head by turning it upside down and using the broom head to scrape the materials off the surface being cleaned. However, the head alone may not be sufficient to scrape the surface and it is subjected to unnecessary wear and tear. Alternatively, a separate cleaning tool such as a scraper may be used. However, the use of a separate cleaning tool may be inconvenient.

As a result, scraper attachments for push brooms have been developed. U.S. Pat. No. 5,123,138 issued Jun. 23, 1992 to Flamm describes a combined push broom and scraping apparatus comprised of a number of parts welded together to form a relatively complex structural arrangement. Further, the apparatus is mounted to the push broom by a series of wood screws screwed directly into the head of the broom. This manner of mounting renders attachment and detachment of the apparatus a relatively time-consuming and difficult task, likely requiring the use of tools to do so. Further, the manner of mounting the apparatus damages the broom head and may weaken it structurally.

Similarly, United Kingdom Patent Application No. 2,150,015A filed Nov. 16, 1983 by Dymott et. al. and published Jun. 26, 1985, describes a combined brushing and scraping tool. The scraping tool is attached to the broom by fasteners which mount directly into both the broom handle and the broom head. Thus, again, attachment and detachment of the tool to the broom are relatively timeconsuming and difficult, likely requiring the use of tools, and both the handle and the head are damaged and may be weakened structurally.

Other prior combination tools such as those described in U.S. Pat. No. 2,163,979 issued Jun. 27, 1939 to Judson and U.S. Pat. No. 2,742,658 issued Apr. 24, 1956 to Sproston have been developed which are mounted to the push broom without damaging it or weakening it structurally. The Sproston patent describes a scraper for attachment to a broom which is comprised of a relatively complex structural arrangement made up of a number of pieces. In the preferred embodiment, the scraper is directly mounted to the broom head by a bolt that passes through the broom head. However, an alternate embodiment is also described for use with a broom head having two sockets in it which merge and form an opening in the bottom of the broom head, thus forming a V-shaped passage. Conventionally, the broom handle is capable of being mounted in either of these sockets. When using the alternate embodiment, the broom handle cannot be mounted to the head conventionally as both sockets are used to mount the scraper to the broom head. This manner of mounting utilizes a U-bolt placed within the sockets and held in place by wing nuts. This manner of mounting also renders attachment and detachment of the scraper relatively time-consuming and difficult to perform.

Although the structure of the actual scraper attachment in the Judson patent is less complex than in the Sproston patent, the manner of mounting the scraper attachment to the push broom in the Judson patent renders attachment and detachment of the scraper attachment relatively time-consuming and difficult to perform. The scraper attachment is only for use with a push broom of the type having two sockets in the head which merge and form an opening in the bottom of the broom head. The scraper attachment is mounted to the handle by a split collar clamp which is held in place by a bolt and a nut. The scraper attachment is mounted to the broom head by one of the sockets in the broom head. A bolt extends from the scraper into one of the sockets and is threaded into a bracket, also located within the socket. The bracket includes a curved arm which extends out the other end of the socket and contacts the outer surface of the head of the broom. Tools may be required to mount the scraper attachment and to tighten it in place on the push broom.

Finally, when using a push broom, the broom handle is subjected to stress which may cause the broom handle to break. This is most likely to occur at the point where the handle is mounted to the broom head. Further, this problem may be compounded when a force is applied through the handle for using the scraper attachment. However, with the exception of the Dymott patent, none of the prior art described herein addresses this difficulty. With respect to the Dymott patent, although the scraper tool includes a brace member, the brace member is mounted into the broom handle, as well as the head, which structurally weakens the portion of the broom which the brace is designed to support. As well, the screws mounting the brace member into the broom handle may tend to loosen over time, rendering the brace member less effective.

There is therefore a need in the industry for a scraper device for attachment to a broom which has a relatively simple structure and which may be attached and detached to the broom in a relatively quick and easy manner as compared to known scraper devices, without damaging the broom such that its structure is weakened. Further, there is a need in the industry for means for bracing the handle of the broom when the scraper device is attached to the broom, without damaging the handle such that the structure of it is weakened.

DISCLOSURE OF INVENTION

The present invention relates to a scraper device for attachment to a broom of the type having a head and a handle, the handle having a lower end for mounting to the head. The scraper device is attachable to and detachable from the broom in a relatively quick and simple manner without causing any damage to the broom that may weaken the broom structurally. Further, the present invention relates to means for bracing the handle and supporting the scraper device when the scraper device is attached to the broom.

In one aspect of the invention, the invention comprises a scraper device for attachment to a broom of the type having a head and a handle, the handle having a lower end for mounting to the head. The scraper device comprises: a blade carrying member, having an upper end and a lower end, for attaching to the broom in a position such that the upper end of the blade carrying member abuts against the handle and the blade carrying member extends downwards and forwards over the head; means for attaching the blade carrying member to the broom when the blade carrying member is positioned for attachment to the broom so that the blade carrying member is secured to the broom and movement of the scraper device relative to the handle is restricted; and a scraper blade located along the lower end of the blade carrying member so that debris may be scraped from a surface by the scraper device when the orientation of the broom is reversed from that normally used for sweeping.

In this aspect of the invention, the scraper device is preferably further comprised of first means, associated with the blade carrying member and substantially parallel to a major axis of the head when the blade carrying member is attached to the broom, for bracing the handle and supporting the blade carrying member when the blade carrying member is attached to the broom. The first bracing means may extend from the blade carrying member to abut against the head when the blade carrying member is positioned for attachment to the broom. The first bracing means engages the abutting surface of the head such that the first bracing means supports the handle from stresses which tend to break the handle at the point where it is mounted to the head and supports the blade carrying member by restricting the movement of the blade carrying member relative to the handle. The first bracing means may be comprised of a discontinuity integral with a lower surface of the blade carrying member such that the discontinuity engages the abutting surface of the head. Preferably, the discontinuity is comprised of a groove defined by the blade carrying member such that the groove is formed from the blade carrying member. However, any shape or form of first bracing means may be used as long as the first bracing means braces the handle and supports the blade carrying member when the blade carrying member is attached to the broom.

Further, the scraper device preferably includes a handle mounting bracket, associated with the blade carrying member, for receiving the handle therein when the blade carrying member is positioned for attachment to the broom. The handle mounting bracket may be integral with the upper end of the blade carrying member. Further, the blade carrying member preferably defines the handle mounting bracket such that the handle mounting bracket is formed from the blade carrying member. As well, at least an upper end of the handle mounting bracket may be shaped to be compatible with the shape of the handle when the scraper device is positioned for attachment to the broom in order to receive the handle within the handle mounting bracket. However, any shape of handle mounting bracket capable of receiving the handle may be used.

As well, the scraper device may further comprise second means, associated with the blade carrying member and oriented so that the second means is not substantially parallel to a major axis of the head when the blade carrying member is attached to the broom, for bracing the handle when the blade carrying member is attached to the broom. The second bracing means is preferably comprised of at least one bracing member depending from a lower surface of the blade carrying member, the bracing member having a top end adjacent to the upper end of the blade carrying member and a bottom end for abutting against an upper surface of the head of the broom such that the bracing member supports the handle from the stresses which tend to break the handle at the point where it is mounted to the head. Suitable bracing means may also be comprised of a pair of bracing members depending from the lower surface of the blade carrying member. However, other arrangements including one or more bracing members are possible, so long as the handle is supported thereby.

Further, the scraper blade is preferably formed by the lower end of the blade carrying member.

The attaching means of the scraper device may comprise a fastening system associated with the blade carrying member which serves to secure the blade carrying member either to the head or the handle, and preferably includes one or more bolts, plugs, cables or other fasteners which couple the blade carrying member to the head or handle without requiring modification of the broom by drilling or screwing.

Suitable attaching means may be comprised of: a clamp member defining two apertures and having a surface for receiving the handle located between the apertures; a pair of fasteners; the blade carrying member defining two openings which are sized and spaced apart from one another in order to accept the fasteners therein and which are positioned next to each other along an axis which is substantially perpendicular to the longitudinal axis of the handle when the blade carrying member is attached to the broom, one opening located on either side of the handle; so that when the handle is mounted to the head and the blade carrying member is positioned for attachment to the broom, the surface of the clamp member can be abutted against the handle at a position on the handle opposite the blade carrying member and the fasteners can be passed through the openings in the blade carrying member and the apertures in the clamp member and secured therein in order to secure the handle between the clamp member and the blade carrying member and restrict the movement of the scraper device relative to the handle. The surface of the clamp member may be shaped to be compatible with the shape of the handle in order to assist in securing the handle between the clamp member and the blade carrying member. As well, the fasteners are preferably comprised of a pair of bolts, each having an end for accepting a tightener, and a pair of tighteners for attaching to the ends of the bolts such that the bolts can be passed through the openings in the blade carrying member and the apertures in the clamp member and the tighteners can be attached to the ends of the bolts and tightened in order to secure the handle between the blade carrying member and the clamp member.

Other suitable attaching means are comprised of: the head including a first socket and a second socket for mounting the handle to the head, the sockets convergingly extending from an upper surface of the head to a lower surface of the head so that they intersect near the lower surface of the head; the blade carrying member defining a hole therein so that when the handle is mounted to the head using the first socket and the blade carrying member is positioned for attachment to the broom, the hole corresponds with the second socket; and a plug having a first end which is sized to fit within the second socket and having a second end which is larger than the hole, in order that the first end of the plug may be passed through the hole and secured within the second socket, and so that the second end of the plug will not pass through the hole and will secure the blade carrying member to the head. The second socket may be threaded and the plug may be sized and threaded so that it may be secured into the second socket and thereby secured to the head. As well, the plug may be long enough to abut against the head at the point of convergence of the sockets when the lower end of the handle is in the first socket and the plug is in the second socket, so as to restrict the movement of the handle in the first socket. As well, the first end of the plug may include means for restraining the handle when the lower end of the handle is in the first socket and the plug is in the second socket.

Still other suitable attaching means may be comprised of: a flexible cable having two ends for accepting tighteners; a pair of tighteners for attaching to the ends of the cable; and the blade carrying member defining at least two openings spaced apart from one another for accepting the cable therethrough and which are positioned next to each other along an axis which is substantially perpendicular to the longitudinal axis of the handle when the blade carrying member is attached to the broom, one opening located on either side of the handle; so that when the handle is mounted to the head and the blade carrying member is positioned for attachment to the broom, the cable can be successively passed through the openings and about the head and the tighteners can be attached to the ends of the cable and tightened in order to secure the cable about the head and restrict the movement of the scraper device relative to the handle. The blade carrying member may define two pairs of openings spaced apart from one another and positioned such that when the handle is mounted to the head and the blade carrying member is positioned for attachment to the broom, one pair of openings is located adjacent to the head on either side of the handle. The ends of the cable may be threaded for accepting the tighteners and the tighteners may be threaded for attaching to the ends of the cable.

BRIEF DESCRIPTION OF DRAWINGS

Embodiments of the invention will now be described with reference to the accompanying drawings, in which.

BEST MODE OF CARRYING OUT INVENTION

Figure 1:
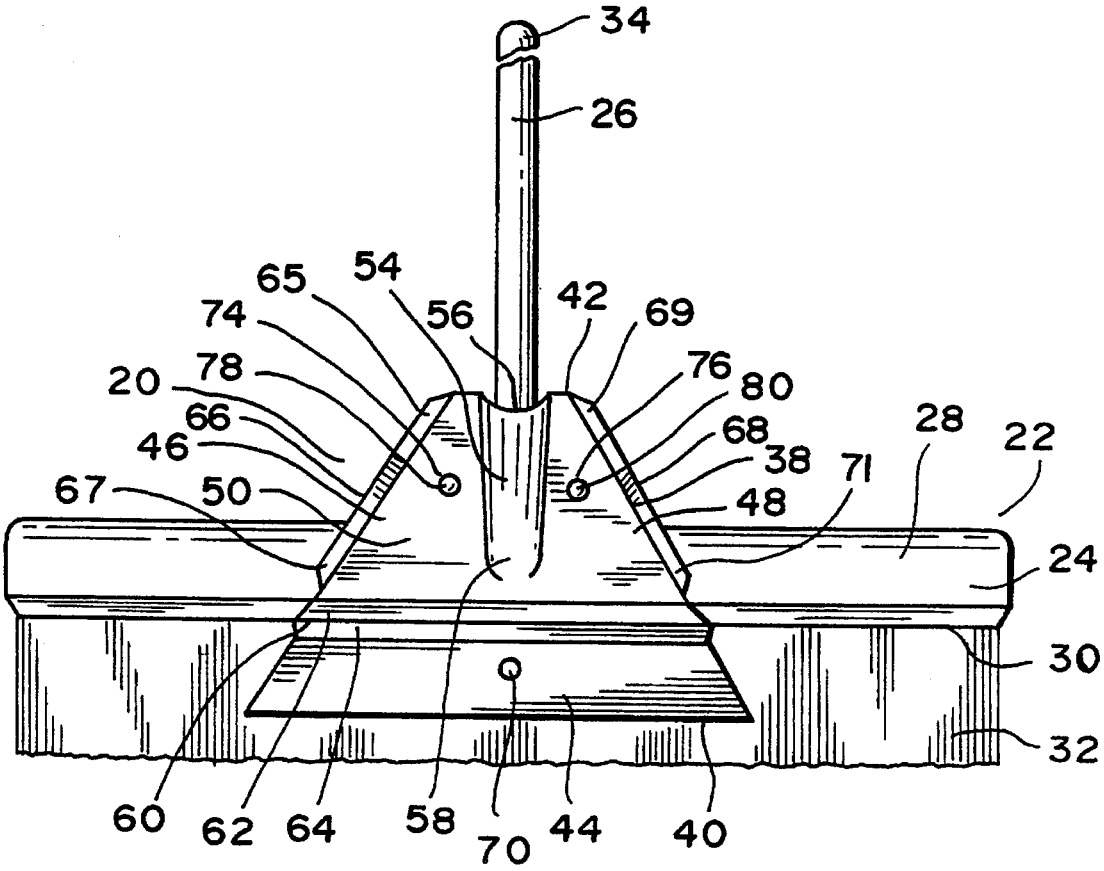
FIG. 1 is a front view of a preferred embodiment of the scraper device attached to a broom.
Figure 2:
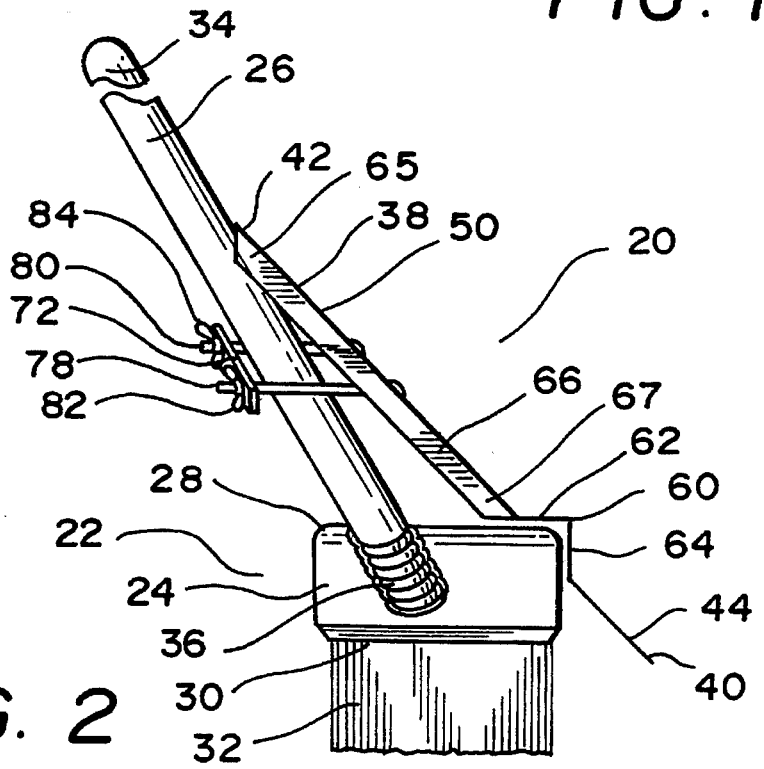
FIG. 2 is a side view, partly in section, of the preferred embodiment of the scraper device attached to the broom.
Figure 3:
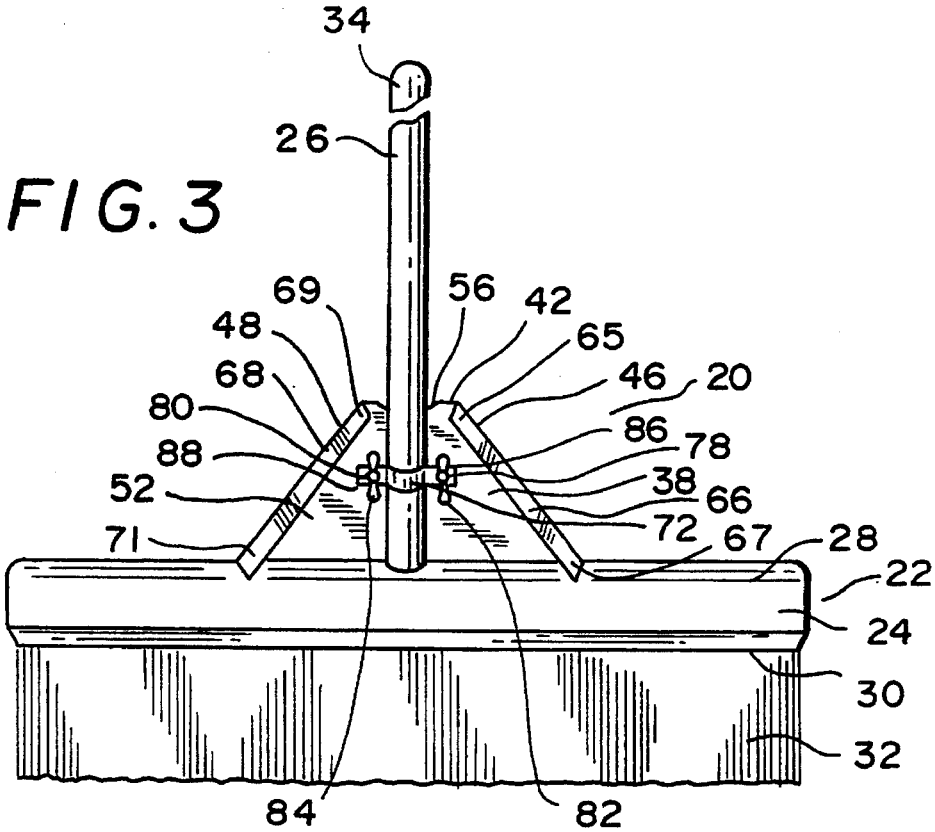
FIG. 3 is a rear view of the preferred embodiment of the scraper device attached to the broom.

Referring to FIGS. 1 through 3, the invention is comprised of a scraper device (20) for attachment to a broom (22). The broom (22) is of a type conventionally known as a push broom or brush broom and having an elongated head (24) and a handle (26). The head (24) is comprised of an upper surface (28) and a lower surface (30) having attached bristles (32) for sweeping. A major axis of the head (24) extends or runs between the upper and lower surfaces (28, 30) of the head (24), substantially parallel to the upper surface (28). The handle (26) is conventionally a pole having an upper end (34) for gripping by the user of the broom (22) and a lower end (36) for mounting to the upper surface (28) of the head (24). The handle (26) typically extends from the upper surface (28) of the head (24) at an angle from vertical orientation in order to allow the user of the broom (22) to grip the upper end (34) of the handle (26) while maintaining the contact of the bristles (32) with the surface to be cleaned.

The scraper device (20) is comprised of a blade carrying member (38), a scraper blade (40), and means for attaching the blade carrying member (38) to the broom (22). As well, the scraper device (20) preferably includes first means for bracing the handle (26) and supporting the blade carrying member (38). The blade carrying member (38) has an upper end (42), a lower end (44), and first and second side edges (46, 48). Further, the blade carrying member (38) has an upper surface (50) and a lower surface (52).

When the handle (26) is mounted to the head (24), the blade carrying member (38) is positioned for attachment to the broom (22) adjacent the lower end (36) of the handle (26). It is positioned such that the upper end (42) of the blade carrying member (38) abuts against the handle (26) and the blade carrying member (38) extends downwards, towards the bristles (32), and forwards over the head (24) of the broom (22). The blade carrying member (38) is positioned so that when the handle (26) of the broom (22) is gripped by the user in a manner for sweeping, with the bristles (32) in contact with the surface to be cleaned, the blade carrying member (38) extends forwards, away from the user on the side of the handle (26) and the head (24) opposite, or not facing, the user. In this position, the lower surface (52) of the blade carrying member (38) is adjacent to, and faces towards, the head (24) and the handle (26) while the upper surface (50) of the blade carrying member (38) faces away from the user. When the blade carrying member (38) is positioned for attachment to the broom (22), a portion or section of the lower surface (52) of the blade carrying member (38) comes into contact with the head (24) of the broom (22) as the blade carrying member (38) extends downwards and forwards over the head (24). The contact between the head (24) and the blade carrying member (38) is described further below.

The blade carrying member (38) extends from its upper end (42) downwards and forwards over the head (24) to its lower end (44). The distance between the upper end (42) and the lower end (44) of the blade carrying member (38), that is, the length of the blade carrying member (38), is determined by several factors. First, the scraper blade (40) located along the lower end (44) of the blade carrying member (38) must be out of contact with the surface to be swept during use of the broom (22) by the user for sweeping. Second, when neither the broom (22) is being used for sweeping nor the scraper device (20) is being used for scraping, the blade carrying member (38) is preferably of sufficient length to allow the scraper device (20) to be used as a free standing stand or prop. To be used as a free standing stand or prop, the broom (22) is first held by the user in a position for sweeping. The handle (24) is then tilted away from the user, such that the broom (22) pivots about the bristles (32). The handle (26) is pushed or tilted away from the user until the scraper blade (40), located along the lower end (44) of the blade carrying member (38), comes into contact with the ground while maintaining the contact of the bristles (32) with the ground. At this point, the user may release the broom (22) and the scraper blade (40) and the bristles (32) act together to prop or maintain the broom (22) in a set position. Preferably, the handle (26) of the broom (22) is independently maintained in a substantially vertical position. Finally, the length of the blade carrying member (38) is preferably sufficient to allow the broom (22) to be stored against a vertical surface, such as a wall, with the bristles (32) out of contact with the ground in order to preserve the bristles (32) against wear. To store against a wall, the broom (22) is again tilted or pushed away from the user towards a wall until the scraper blade (40) comes into contact with the ground. The broom (22) is then further tilted or pushed away from the user, such that the broom (22) pivots about the scraper blade (40) and the bristles (32) are lifted from the ground, until the upper end (34) of the handle (26) comes in contact with the wall. The broom (22) may then be released by the user.

The blade carrying member (38) preferably includes a handle mounting bracket (54) for receiving the handle (26) therein when the blade carrying member (38) is positioned, as discussed above, for attachment to the broom (22). The handle mounting bracket (54) is preferably integral with the upper end (42) of the blade carrying member (38). The handle mounting bracket (54) may be comprised of a separate member or part integrally connected to the lower surface (52) of the blade carrying member (38). However, in the preferred embodiment, the handle mounting bracket (54) is defined by the blade carrying member (38) such that the handle mounting bracket (54) is formed from or by the blade carrying member (38). The blade carrying member (38) is constructed out of a single piece of sheet metal which is stamped or bent to form the handle mounting bracket (54) therein. However, the blade carrying member (38) and the handle mounting bracket (54) may also be molded out of a single piece of plastic.

Preferably, the handle mounting bracket (54) extends from an upper end (56), formed from the upper end (42) of the blade carrying member (38), for a distance towards the lower end (44) of the blade carrying member (38), to terminate at a lower end (58). As well, it is preferably located approximately midway between the first and second side edges (46, 48) of the blade carrying member (38).

The handle mounting bracket (54) is shaped so that at least the upper end (56) of the handle mounting bracket (54), which abuts against the handle (26), is compatible with the shape of the handle (26) in order that the handle (26) is securely received within the upper end (56) of the bracket (54). Thus, the lower surface (52) of the blade carrying member (38) forming the upper end (56) of the handle mounting bracket (54) is substantially concave and forms a C-shape to receive the convex handle (26) therein. As the handle mounting bracket (54) extends from its upper end (56) towards its lower end (58), the bracket (54) is tapered to become increasingly more shallow such that its lower end (58) is substantially flattened out to join smoothly with the surface of the blade carrying member (38) not forming the handle mounting bracket (54). As well, when the blade carrying member (38) is positioned for attachment to the broom (22), as the handle mounting bracket (54) extends away from its upper end (56) towards its lower end (58), the bracket (54) no longer abuts against the handle (26) and the handle (26) is increasingly less contained or secured within the bracket (54). Eventually, at the lower end (58) of the handle mounting bracket (54), the handle (26) is completely out of contact with the lower surface (52) of the blade carrying member (38) forming the handle mounting bracket (54) and is completely outside the confines of the handle mounting bracket (54). The lower end (58) of the handle mounting bracket (54) is located above, or nearer to the upper end (42) of the blade carrying member (38) than, the portion of the lower surface (52) of the blade carrying member (38) which contacts the head (24) of the broom (22) when the blade carrying member (38) is positioned for attachment to the broom (22).

Finally, the edge of the upper end (56) of the handle mounting bracket (54) is preferably curved or tapered at the point that it actually abuts against the handle (26) to more closely conform to the handle (26). Specifically, if the edge of the upper end (56) abuts the handle (26) at too large an angle, the handle (26) will not be as securely received and retained within the handle mounting bracket (54) when the scraper device (20) is attached to the broom (22). Therefore the edge of the upper end (56) is curved in such a manner that the angle between the edge and the handle (26) is minimized. In the preferred embodiment, the edge of the upper end (56) of the handle mounting bracket (54) is curved outwards sufficiently to form a lip which lies flat against the handle (26).

First means for bracing the handle (26) and supporting the blade carrying member (38) are associated with the blade carrying member (38) and are substantially parallel to the major axis of the head (24) when the blade carrying member (38) is attached to the broom (22). When the blade carrying member (38) is attached to the broom (22), the first bracing means braces the handle by supporting the handle (26) from the stresses which tend to break the handle (26) at the point where it is mounted to the head (24). Further, the first bracing means supports the blade carrying member (38) by restricting the movement of the blade carrying member (38) relative to the handle (26). In the preferred embodiment, the first bracing means is comprised of a discontinuity, preferably a groove (60), integral with the lower surface (52) of the blade carrying member (38). Although the discontinuity is preferably a groove (60), it may be comprised of a ridge, wrinkle, fold, furrow, etc., in the lower surface (52) of the blade carrying member (38) as long as the discontinuity engages the abutting surface of the head (24). In the preferred embodiment, the groove (60) is located between the upper end (42) and the lower end (44) of the blade carrying member (38) and extends from the first side edge (46) to the second side edge (48) of the blade carrying member (38), and is oriented to be substantially parallel to the major axis of the head (24) when the blade carrying member (38) is attached to the broom (22). The groove (60) may be comprised of a separate member or part integrally connected to the blade carrying member (38), however, the groove (60) is preferably defined by the blade carrying member (38) such that the groove (60) is formed from or by the blade carrying member (38). In the preferred embodiment, the blade carrying member (38) is constructed out of a single piece of sheet metal which is stamped or bent to form the groove (60) therein. However, the blade carrying member (38) and the groove (60) may also be molded from a single piece of plastic.

When the blade carrying member (38) is positioned for attachment to the broom (22), the groove (60) is formed in the blade carrying member (38) at a location adjacent to the head (24) of the broom (22) such that the portion of the lower surface (52) of the blade carrying member (38) forming the groove (60) abuts against the head (24). The groove (60) is shaped to engage the surface of the head (24) at the point where the groove (60) abuts the head (24) in a manner such that the handle (26) and the blade carrying member (38) are braced and supported thereby.

To engage the abutting surface of the head (24) when the scraper device (20) is attached to the broom (22), the groove (60) is comprised of an upper portion (62) and a lower portion (64). When attached to the broom (22), the blade carrying member (38) extends downwards and forwards from its upper end (42) to the upper portion (62) of the groove (60) along a first plane. The upper portion (62) of the groove (60) extends at an angle to the first plane away from the handle (26) so that the upper portion (62) of the groove

(60) is positioned to contact the head (24) such that downward movement of the blade carrying member (38) relative to the handle (26), that is, movement towards the bristles (32), is limited or restricted. The lower portion (64) of the groove (60) is connected to the upper portion (62) and extends at an angle to the first plane towards the longitudinal axis of the handle (26), to form a V-shaped ridge with the upper portion (62). The lower portion (64) of the groove (60) is positioned to contact the head (24) such that upward movement of the blade carrying member (38) relative to the handle (26), that is movement towards the upper end (34) of the handle (26), is limited or restricted. Finally, the blade carrying member (38) extends downwards and forwards from the lower portion (64) of the groove (60) to the lower end (44) of the blade carrying member (38) along a second plane substantially coplanar to the first plane.

As stated, when the blade carrying member (38) is attached to the broom (22) by the attaching means, the groove (60) abuts against the head (24) which braces the handle (26) by lessening the stresses at the point where the handle (26) is mounted to the head (24), and which supports the blade carrying member (38) by restricting the movement of the blade carrying member (38) relative to the handle (26). As well, when the scraper device (20) is attached to the broom (22), the groove (60) and the means for attaching the blade carrying member (38) to the broom (22) may act together to hold the head (24) and the handle (26) in proper relation to each other even when the head (24) is poorly or insecurely mounted to the handle (26). Further, the groove (60) and the attaching means may also act together to minimize unwanted movement or rotation of the handle (26) relative to the head (24). For example, the head (24) may include a threaded socket for accepting a threaded lower end (36) of the handle (26). During use, the handle (26) may tend to loosen up and unscrew from the socket in the head (24). The groove (60) and the attaching means may aid in minimizing the rotation of the handle (26) relative to the head (24), thus assisting in maintaining a tight fit or connection between the head (24) and the handle (26). Further, even if the handle (26) becomes unscrewed from the head (24), the groove (60) and the attaching means may hold the head (24) and the handle (26) in proper relation to each other during use of the broom (22) or scraper device (20).

A scraper blade (40) is located along the lower end (44) of the blade carrying member (38). In the preferred embodiment, the scraper blade (40) extends from the first side edge (46) to the second side edge (48) of the blade carrying member (38) along the entire length of the lower end (44). The lower end (44) of the blade carrying member (38), and as a result, the scraper blade (40) must be of a sufficient width to provide for sufficient scraping of a surface by the scraper device (20) and allow for the use of the scraper device (20) as a stand or prop as described above.

In the preferred embodiment, the scraper blade (40) is integral with the blade carrying member (38) and is formed by the lower end (44) of the blade carrying member (38). Thus, the scraper blade (40) is also constructed of sheet metal in the preferred embodiment. Where the blade carrying member (38) is made of another material such as plastic, it is preferred to mount a scraper blade (40) constructed of a metal along the lower end (44) of the blade carrying member (38) to improve the wear of the scraper device (20).

Further, the blade carrying member (38) may include a rib (not shown) for increasing the rigidity of the scraper blade (40). The rib is located at the lower end (44) of the blade carrying member (38) such that it is positioned adjacent the scraper blade (40) and has a longitudinal axis which is substantially parallel with the longitudinal axis of the scraper blade (40). A greater number of ribs may be used as required to increase the rigidity of the scraper blade (40).

As stated, when the scraper device (20) is attached to the broom (22) and the attaching means are employed, the scraper blade (40) is out of contact with the surface to be cleaned during normal use of the broom (22). The scraper blade (40) does not interfere with the normal use of the broom (22). The scraper device (20) is utilized by reversing the orientation of the broom (22) from that normally used for sweeping. The upper surface (50) of the blade carrying member (38) faces and is adjacent to the surface to be cleaned by the scraper device (20) and the bristles (32) are out of contact with the surface to be cleaned.

During use of the scraper device, debris scraped from the surface being cleaned may become trapped between the bristles (32) or the head (24) and the scraper device (20). Further, debris may become similarly trapped when using the broom (22) for sweeping. As a result, the scraper device (20) may include a cleaning flange (not shown). The cleaning flange depends from the lower surface (52) of the blade carrying member (38) at its lower end (44). Further, the longitudinal axis of the cleaning flange is substantially parallel with the scraper blade (40). As a result, when the scraper device (20) is attached to the broom (22), the cleaning flange is directed towards the head (24). Thus, the cleaning flange blocks the space between the scraper device (20) and the head (24) and limits any debris being trapped therebetween. Preferably, the cleaning flange would be constructed of metal similar to the blade carrying member (38) and be welded to the lower surface (52) of the blade carrying member (38).

Further, the scraper device (20) preferably includes second means for bracing the handle (26) when the scraper device (20) is attached to the broom (22). The second bracing means is oriented so that it is not substantially parallel to the major axis of the head (24) when the blade carrying member (38) is attached to the broom (22). In the preferred embodiment, the second bracing means is a pair of bracing members (66, 68) which depend from the lower surface (52) of the blade carrying member (38). The bracing members (66, 68) are flanges or protrusions from the blade carrying member (38). A first bracing member (66) is located adjacent the first side edge (46) of the blade carrying member (38) and has a top end (65) located adjacent to the upper end (42) of the blade carrying member (38) and a bottom end (67) for abutting against the upper surface (28) of the head (24). A second bracing member (68) is located adjacent the second side edge (48) of the blade carrying member (38) and has a top end (69) located adjacent to the upper end (42) of the blade carrying member (38) and a bottom end (71) for abutting against the upper surface (28) of the head (24). As indicated, both bracing members (66, 68) extend from their top ends (65, 69) adjacent the upper end (42) of the blade carrying member (38), along the side edges (46, 48) of the blade carrying member (38). The bracing members (66, 68) have longitudinal axes from their top ends (65, 69) to their bottom ends (67, 71) at angles to the major axis of the head (24) so that the bracing members (66, 68) intersect the head (24) and abut against it. However, the angles of the longitudinal axes of the bracing members (66, 68) must not be substantially parallel to the major axis of the head (24) as abutment of the bracing members (66, 68) against the head (24) will not occur. Therefore, the bracing members (66, 68) are oriented so that their longitudinal axes are not substantially parallel to the head (24) when the blade carrying member (38) is attached to the broom (22). The angle or orientation of the first bracing member (66) need not be the same as that of the second bracing member (68).

When the scraper device (20) is attached to the broom (22), the bottom ends (67, 71) of the bracing members (66, 68) abut against the upper surface (28) of the head (24) so that the bracing members (66, 68) brace and support the handle (26). Further, the abutment of the bottom ends (67, 71) of the bracing members (66, 68) against the head (24) restricts the downward movement, or movement away from the upper end (34) of the handle (26), of the scraper device (20) relative to the handle (26).

In the preferred embodiment, the bracing members (66, 68) are integral with the blade carrying member (38). The blade carrying member (38), including the bracing members (66, 68) are cut from sheet metal. The bracing members (66, 68) are then bent or folded towards the lower surface (52) of the blade carrying member (38) to depend therefrom. Although the second bracing means are preferably comprised of two bracing members (66, 68) as described above, other arrangements including one or more bracing members are possible as long as the bracing member depends from the lower surface (52) of the blade carrying member (38) and contacts the head (24) in order to brace and support the handle (26) from the stresses which tend to break the handle (26) at the point where it is mounted to the head (24).

The preferred embodiment further includes a hanging hole (70). The hanging hole (70) is defined by the blade carrying member (38) and is located adjacent the lower end (44) of the blade carrying member (38). Further, the hanging hole (70) is located approximately midway between the first side edge (46) and the second side edge (48) of the blade carrying member (38). When the scraper device (20) is attached to the broom (22) and the attaching means are employed, the hanging hole (70) is used for storing the broom (22) by placing the hanging hole (70) over a hook, nail or similar protrusion located on a wall. In this manner, the broom (22) with the attached scraper device (20) may be safely and conveniently stored.

As stated above, the scraper device (20) includes means for attaching the blade carrying member (38) to the broom (22) when the blade carrying member (38) is positioned for attachment to the broom (22) so that the blade carrying member (38) is secured to the broom (22). Thus, the attaching means act to restrict the movement of the scraper device (20) relative to the handle (26), or in other words, the movement of the scraper device (20) towards or away from the upper end (34) of the handle (26). The attaching means are comprised of a fastening system associated with the blade carrying member (38) for securing the blade carrying member (38) to either the head (24) or the handle (26) of the broom (22). Further, the attaching means include one or more bolts, plugs, cables or other fasteners which couple the blade carrying member (38) to the broom (22) without requiring modification of the broom (22) by drilling or screwing.

In the preferred embodiment, as shown in FIGS. 1 through 3, the attaching means are comprised of a pair of fasteners, a clamp member (72) and the blade carrying member (38) defining a first opening (74) and a second opening (76). The pair of fasteners include a first bolt (78) and a second bolt (80), each having a threaded end for accepting a tightener. The fasteners further include a first tightener (82) and a second tightener (84) compatibly threaded for attaching to the ends of the first and second bolts (78, 80) respectively. The clamp member (72) defines a first aperture (86) and a second aperture (88) therein and has a surface for receiving the handle (26) located between the apertures (86, 88). In the preferred embodiment, the surface of the clamp member (72) is shaped to be compatible with the surface of the handle (26). As a result, the handle (26) may be more easily and closely secured between the clamp member (72) and the handle mounting bracket (54), as described below.

The first and second openings (74, 76) in the blade carrying member (38) are sized and spaced apart from one another in order to accept the ends of the first and second bolts (78, 80) therein. Further, the first and second openings (74, 76) are positioned next to each other along an axis which is substantially perpendicular to the longitudinal axis of the handle mounting bracket (54) and the handle (26) when the blade carrying member (38) is attached to the broom (22). Finally, when the blade carrying member (38) is positioned for attachment to the broom (22), the first and second openings (74, 76) are located between the upper end (42) of the blade carrying member (38) and the head (24) of the broom (22) and one of the first and second openings (74, 76) is located on each side of the handle mounting bracket (54).

As a result of the placement of the first and second openings (74, 76), when the handle (26) is mounted to the head (24) and the blade carrying member (38) is positioned for attachment to the broom (22), the surface of the clamp member (72) can be abutted against the handle (26) at a position on the handle (26) opposite to the handle mounting bracket (54). The first bolt (78) can then be passed through the first opening (74) in the blade carrying member (38) and the first aperture (86) in the clamp member (72) and the second bolt (80) can be passed through the second opening (76) in the blade carrying member (38) and the second aperture (88) in the clamp member (72). The first tightener (82) can then be attached to the end of the first bolt (78) and the second tightener (84) can be attached to the end of the second bolt (80). The tighteners (82, 84) can then be tightened in order to secure the handle (26) between the handle mounting bracket (54) and the surface of the clamp member (72).

In the preferred embodiment, the ends of the first and second bolts (78, 80) are passed from the upper surface (50) of the blade carrying member (38) to the lower surface (52) and the tighteners (82, 84) are affixed to the ends of the bolts (78, 80) adjacent to the clamp member (72). However, the ends of the first and second bolts (78, 80) may also be passed in an opposite manner, through the clamp member (72) and the lower surface (52) of the blade carrying member (38) to the upper surface (50) of the blade carrying member (38) so that the tighteners (82, 84) are affixed to the ends of the bolts (78, 80) adjacent to the upper surface (50) of the blade carrying member (38).

As an alternative to using a pair of fasteners and a clamp member (72), the attaching means may include a U-shaped bolt (not shown), having two ends for receiving tighteners thereon, and a pair of tighteners (not shown). The U-shaped bolt can be positioned around the handle (26) and the ends of the U-shaped bolt can be passed from the lower surface (52) of the blade carrying member (38), through the first and second openings (74, 76) to the upper surface (50) of the blade carrying member (38). The ends of the U-shaped bolt are threaded for accepting the tighteners. The tighteners are compatibly threaded for attaching to the ends of the U-shaped bolt. Thus, when the U-shaped bolt is in position around the handle (26), the tighteners can be attached to the ends of the U-shaped bolt and tightened against the upper surface (50) of the blade carrying member (38) in order to secure the U-shaped bolt to the handle (26) and restrict the movement of the scraper device (20) relative to the handle (26). To more positively secure the U-shaped bolt to the handle (26), the surface of the U-shaped bolt may be textured by threads that extend over substantially the entire length of the U-shaped bolt.

Figure 4:
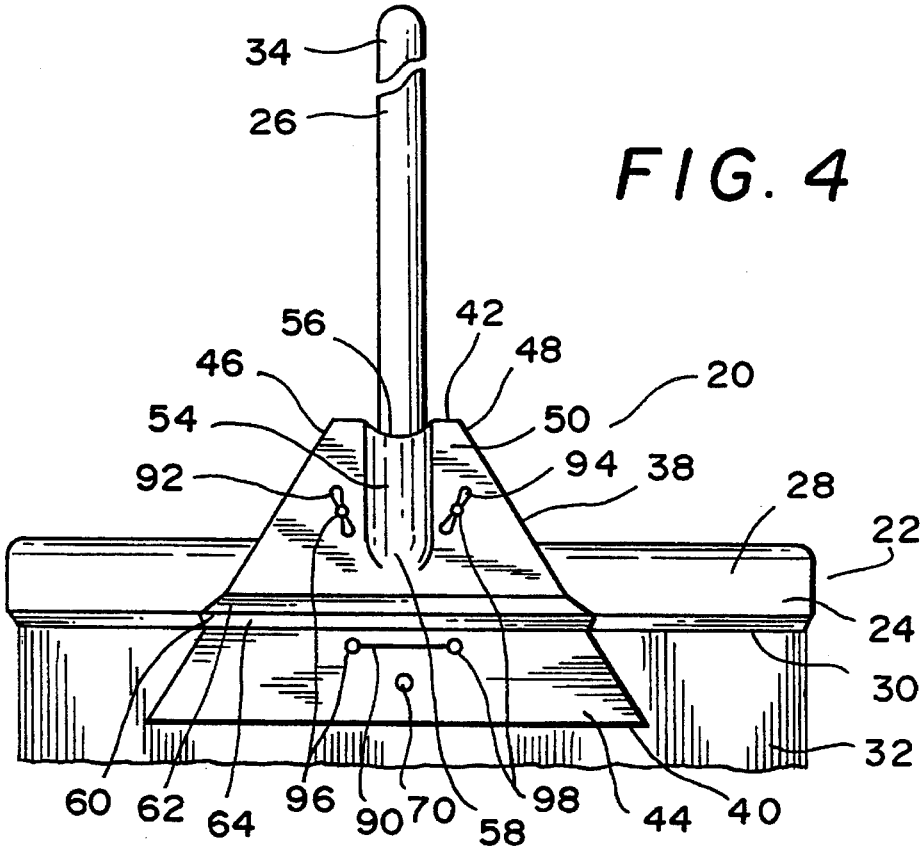
FIG. 4 is a front view of a second embodiment of the scraper device attached to the broom.
Figure 5:
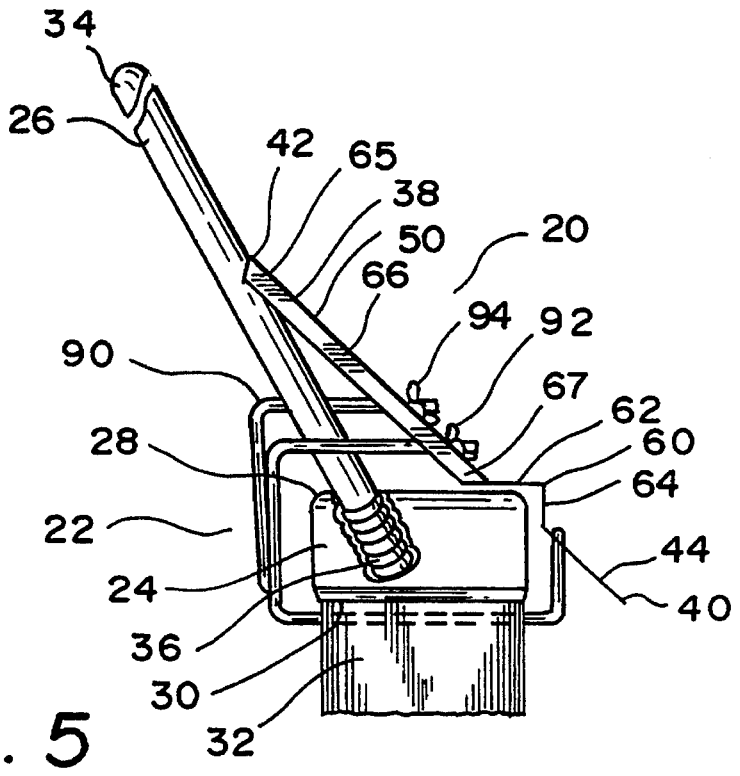
FIG. 5 is a side view, partly in section, of the second embodiment of the scraper device attached to the broom.
Figure 6:
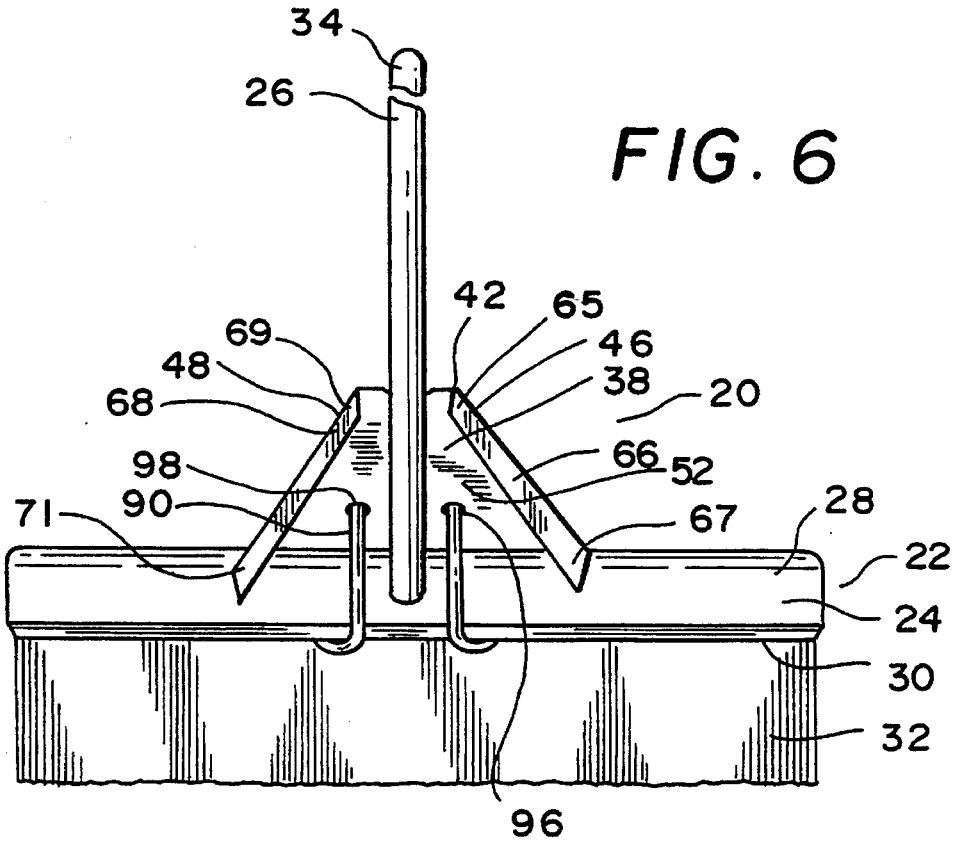
FIG. 6 is a rear view of the second embodiment of the scraper device attached to the broom.

In a second embodiment of the scraper device (20), as shown in FIGS. 4 through 6, the attaching means are comprised of a fastener, being a flexible cable (90), a pair of tighteners (92, 94) and the blade carrying member (38) defining a first and second pair of openings (96, 98). More or fewer openings may be used as required to attach the scraper device (20). With respect to each pair of openings (96, 98) in the preferred form of the second embodiment, the two openings of each pair are spaced apart from one another and are positioned next to each other along an axis which is substantially parallel to the longitudinal axis of the handle mounting bracket (54) or the handle (26) when the scraper device (20) is attached to the broom (22). Further, the first and second pairs of openings (96, 98) are spaced apart from one another and positioned such that when the blade carrying member (38) is positioned for attachment to the broom (22), one pair of openings is located adjacent to the head (24) on either side of the handle (26). Thus, the first pair of openings (96) is located between the handle (26) and the first side edge (46) of the blade carrying member (38) and the second pair of openings (98) is located between the handle (26) and the second side edge (48).

As a result of the placement of the pairs of openings (96, 98), when the handle (26) is mounted to the head (24) and the blade carrying member (38) is positioned for attachment to the broom (22), the ends of the cable (90) can be successively passed through the openings (96, 98) and about the head (24). For example, the cable (90) may pass from the upper surface (50) of the blade carrying member (38), through the opening in the first pair of openings (96) nearest to the upper end (42) of the blade carrying member (38), around the head (24), through the opening in the first pair of openings (96) nearest to the lower end (44) of the blade carrying member (38). The cable (90) then passes across the upper surface (50) of the blade carrying member (38), through the opening in the second pair of openings (98) nearest to the lower end (44) of the blade carrying member (38), around the head (24), and through the opening in the second pair of openings (98) nearest to the upper end (42) of the blade carrying member (38) to the upper surface (50) of the blade carrying member (38). The specific passing of the cable (90) may vary as long as the cable (90) loops around the head (24) and the ends of the cable (90) are located on the upper surface (50) of the blade carrying member (38) for ease of access to them.

The ends of the cable (90) are threaded for accepting the tighteners (92, 94). The tighteners (92, 94) are compatibly threaded for attaching to the ends of the cable (90). Thus, when the cable (90) is in position around the head (24), the tighteners (92, 94) can be attached to the ends of the cable (90) and tightened against the upper surface (50) of the blade carrying member (38) in order to secure the cable (90) about the head (24) and restrict the movement of the scraper device (20) relative to the head (26).

Figure 7:
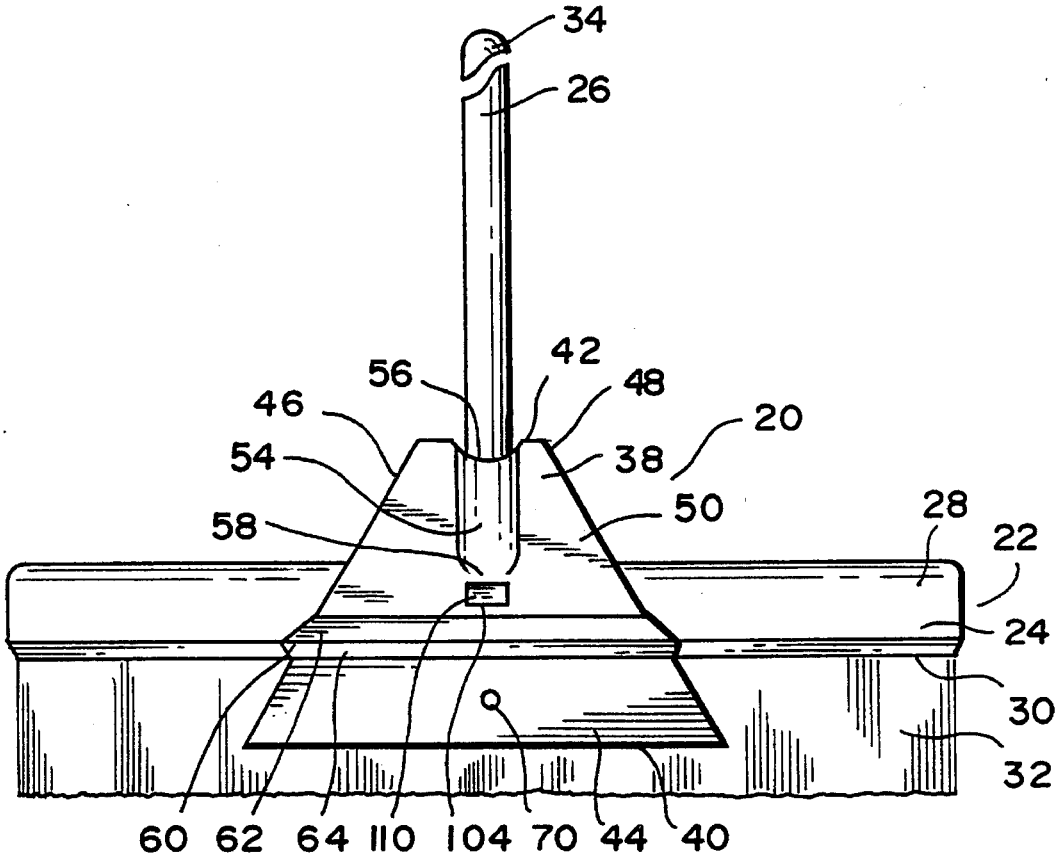
FIG. 7 is a front view of a third embodiment of the scraper device attached to the broom.
Figure 8:
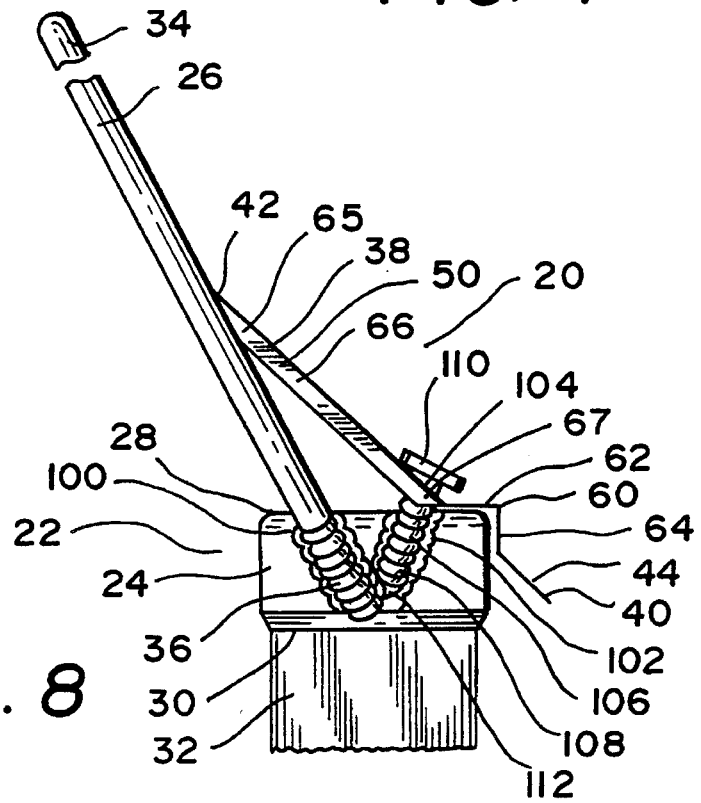
FIG. 8 is a side view, partly in section, of the third embodiment of the scraper device attached to the broom.
Figure 9:
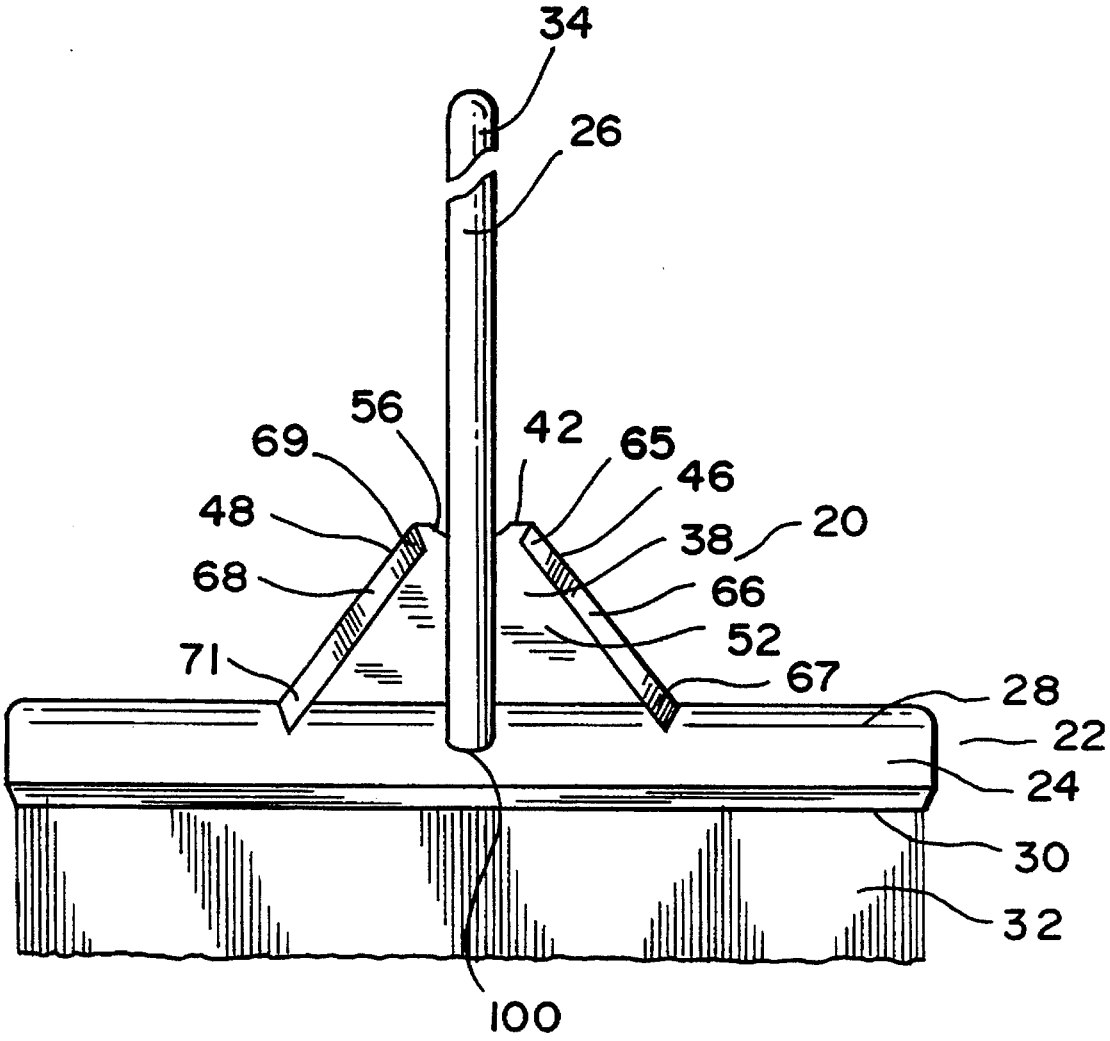
FIG. 9 is a rear view of the third embodiment of the scraper device attached to the broom.

In a third embodiment of the scraper device (20), as shown in FIGS. 7 through 9, the attaching means are comprised of the head (24) including a first socket (100) and a second socket (102), a hole (104) in the blade carrying member (38) and a fastener, being a plug (106). As shown in FIG. 8, the sockets (100, 102) convergingly extend from the upper surface (28) of the head (24) to the lower surface (30) of the head (24) so that they intersect near the lower surface (30). In a conventional broom, the two sockets (100, 102) are substantially identical and at approximately right angles to each other. Thus, a V-shaped passage is formed in the head (24). Both sockets (100, 102) are threaded such that a threaded lower end (36) of the handle (26) may be mounted in either socket (100, 102) as desired. In the preferred form of the third embodiment, the lower end (36) of the handle (26) is mounted in the first socket (100).

As stated, the blade carrying member (38) defines a hole (104). When the handle (26) is mounted to the head (24) using the first socket (100), and the blade carrying member (38) is positioned for attachment to the broom (22) such that the handle (26) is received within the handle mounting bracket (54) and the groove (60) engages the abutting surface of the head (24), the hole (104) corresponds with the second socket (102). The second socket (102) is threaded for receiving the plug (106) and the plug (106) is sized and threaded so that it may be secured into the second socket (102) and thereby secured to the head (24).

The plug (106) has a first end (108) which is sized to fit within the second socket (102) and a second end (110) which is larger than the hole (104). Thus, in use, the first end (108) of the plug (106) is passed through the hole (104) and secured within the second socket (102) by tightening the plug (106). The second end (110) of the plug (106) will not pass through the hole (104) and therefore secures the blade carrying member (38) to the head (24).

Further, the plug (106) is long enough for the first end (108) to abut against the handle (26) at the point of convergence of the first and second sockets (100, 102) when the lower end (36) of the handle (26) is in the first socket (100) and the plug (106) is in the second socket (102). The abutment of the plug (106) against the handle (26) restricts the movement of the handle (26) in the first socket (100) thus inhibiting the loosening of the handle (26) during use of the broom (22) or scraper device (20). To further restrict movement, the first end (108) of the plug (106) includes means for restraining the handle (26). The restraining means are comprised of a point (112) at the first end (108) of the plug (106). The point (112) engages the handle (26) when the lower end (36) of the handle (26) is in the first socket (100) and the plug (106) is in the second socket (102), and thereby restricts its movement. Other restraining means may also be used such as a rubber pad (not shown) at the first end (108) of the plug (106).

The embodiments of the invention in which an exclusive property or privilege is claimed are defined as follows:

1. A scraper device for attachment to a broom of the type including a head having an upper surface, a lower surface, and a major axis and a handle, the handle having a longitudinal axis and a lower end for mounting to the head, the scraper device comprising:

(a) a blade carrying member for attaching to the broom, the blade carrying member having an upper end for abutting against the handle of the broom, a lower end, an upper surface and a lower surface;

(b) means for attaching the blade carrying member to the broom in a position such that the upper end of the blade carrying member abuts against the handle and the blade carrying member extends downwards and forwards over the head so that movement of the scraper device relative to the handle is restricted;

(c) first means for bracing the handle and supporting the blade carrying member when the blade carrying member is attached to the broom wherein the first bracing means is integral with the blade carrying member and extends from the blade carrying member such that the first bracing means abuts against and engages the head on each side of the longitudinal axis of the handle when the blade carrying member is positioned for attachment to the broom without having to be fastened to the broom at the points of abutment against the head in order that the first bracing means supports the handle from stresses which tend to break the handle at the point where the handle is mounted to the head and supports the blade carrying member by restricting the movement of the blade carrying member relative to the handle; and (d) a scraper blade located along the lower end of the blade carrying member so that debris may be scraped from a surface by the scraper device when the orientation of the broom is reversed from that normally used for sweeping.

2. The scraper device as claimed in claim 1 wherein the first bracing means is substantially parallel to the major axis of the head when the blade carrying member is attached to the broom.

3. The scraper device as claimed in claim 2 wherein the first bracing means is comprised of at least one discontinuity integral with the lower surface of the blade carrying member such that the discontinuity engages the abutting surface of the head.

4. The scraper device as claimed in claim 3 wherein the discontinuity is comprised of a groove defined by the blade carrying member such that the groove is formed from the blade carrying member.

5. The scraper device as claimed in claim 4 wherein the blade carrying member has a first side edge and a second side edge and the discontinuity is comprised of a single groove extending from the first side edge to the second side edge.

6. The scraper device as claimed in claim 2 further comprising second means, associated with the blade carrying member and oriented so that the second means is not parallel to the major axis of the head when the blade carrying member is attached to the broom, for bracing the handle when the blade carrying member is attached to the broom.

7. The scraper device as claimed in claim 6 wherein the second bracing means is comprised of at least one bracing member depending from the lower surface of the blade carrying member, the bracing member having a top end adjacent to the upper end of the blade carrying member and a bottom end for abutting against the upper surface of the head of the broom such that the bracing member supports the handle from the stresses which tend to break the handle at the point where it is mounted to the head.

8. The scraper device as claimed in claim 7 wherein the second bracing means is comprised of a pair of bracing members depending from the lower surface of the blade carrying member.

9. The scraper device as claimed in claim 6 wherein the second bracing means is comprised of a pair of bracing members depending from the lower surface of the blade carrying member and integral with the blade carrying member, said second bracing means abutting against the head when the scraper device is attached to the broom without having to be fastened to the broom at the points of abutment against the head, to support the handle from the stresses which tend to break the handle at the point where it is mounted to the head.

10. The scraper device as claimed in claim 4 wherein the attaching means is comprised of a fastening system associated with the blade carrying member for securing the blade carrying member to the broom.

11. The scraper device as claimed in claim 10 wherein the fastening system comprises at least one fastener for coupling the blade carrying member to the broom without requiring modification of the broom.

12. The scraper device as claimed in claim 4 wherein the attaching means is comprised of:

(a) a clamp member defining two apertures and having a surface for receiving the handle located between the apertures;

(b) a pair of fasteners;

(c) the blade carrying member defining two openings which are sized and spaced apart from one another in order to accept the fasteners therein and which are positioned next to each other along an axis which is substantially perpendicular to the longitudinal axis of the handle when the blade carrying member is attached to the broom, one opening located on each side of the longitudinal axis of the handle when the blade carrying member is positioned for attachment to the broom;

so that when the handle is mounted to the head and the blade carrying member is positioned for attachment to the broom, the surface of the clamp member can be abutted against the handle at a position on the handle opposite the blade carrying member and the fasteners can be passed through the openings in the blade carrying member and the apertures in the clamp member and secured therein in order to secure the handle between the clamp member and the blade carrying member and restrict the movement of the scraper device relative to the handle.

13. The scraper device as claimed in claim 1 further comprising a handle mounting bracket, associated with the blade carrying member, for receiving the handle therein when the blade carrying member is positioned for attachment to the broom.

14. The scraper device as claimed in claim 13 wherein the handle mounting bracket is integral with the upper end of the blade carrying member.

15. The scraper device as claimed in claim 14 wherein the blade carrying member defines the handle mounting bracket such that the handle mounting bracket is formed from the blade carrying member.

16. The scraper device as claimed in claim 15 wherein the handle mounting bracket has an upper end and at least the upper end of the handle mounting bracket is shaped to be compatible with the shape of the handle when the scraper device is positioned for attachment to the broom in order to receive the handle within the handle mounting bracket.

17. The scraper device as claimed in claim 1 wherein the scraper blade is formed by the lower end of the blade carrying member.

18. The scraper device as claimed in claim 1 wherein the attaching means is comprised of a fastening system associated with the blade carrying member for securing the blade carrying member to the broom.

19. The scraper device as claimed in claim 18 wherein the fastening system comprises at least one fastener for coupling the blade carrying member to the broom without requiring modification of the broom.

20. The scraper device as claimed in claim 1 wherein the attaching means is comprised of:

(a) a clamp member defining two apertures and having a surface for receiving the handle located between the apertures;

(b) a pair of fasteners;

(c) the blade carrying member defining two openings which are sized and spaced apart from one another in order to accept the fasteners therein and which are positioned next to each other along an axis which is substantially perpendicular to the longitudinal axis of the handle when the blade carrying member is attached to the broom, one opening located on each side of the longitudinal axis of the handle when the blade carrying member is positioned for attachment to the broom;

so that when the handle is mounted to the head and the blade carrying member is positioned for attachment to the broom, the surface of the clamp member can be abutted against the handle at a position on the handle opposite the blade carrying member and the fasteners can be passed through the openings in the blade carrying member and the apertures in the clamp member and secured therein in order to secure the handle between the clamp member and the blade carrying member and restrict the movement of the scraper device relative to the handle.

21. The scraper device as claimed in claim 20 wherein the surface of the clamp member is shaped to be compatible with the shape of the handle in order to assist in securing the handle between the clamp member and the blade carrying member.

22. The scraper device as claimed in claim 20 wherein the fasteners are comprised of a pair of bolts, each having an end for accepting a tightener, and a pair of tighteners for attaching to the ends of the bolts such that the bolts can be passed through the openings in the blade carrying member and the apertures in the clamp member and the tighteners can be attached to the ends of the bolts and tightened in order to secure the handle between the blade carrying member and the clamp member.

23. The scraper device as claimed in claim 1 wherein the attaching means is comprised of:

(a) the head including a first socket and a second socket for mounting the handle to the head, the sockets convergingly extending from the upper surface of the head to the lower surface of the head so that they intersect near the lower surface of the head;

(b) the blade carrying member defining a hole therein so that when the handle is mounted to the head using the first socket and the blade carrying member is positioned for attachment to the broom, the hole corresponds with the second socket; and (c) a plug having a first end which is sized to fit within the second socket and having a second end which is larger than the hole, in order that the first end of the plug may be passed through the hole and secured within the second socket, and so that the second end of the plug will not pass through the hole and will secure the blade carrying member to the head.

24. The scraper device as claimed in claim 23 wherein the second socket is threaded and the plug is sized and threaded so that it may be secured into the second socket and thereby secured to the head.

25. The scraper device as claimed in claim 24 wherein the plug is long enough to abut against the head at the point of convergence of the sockets when the lower end of the handle is in the first socket and the plug is in the second socket, so as to restrict the movement of the handle in the first socket.

26. The scraper device as claimed in claim 25 wherein the first end of the plug includes means for restraining the handle when the lower end of the handle is in the first socket and the plug is in the second socket.

27. The scraper device as claimed in claim 1 wherein the attaching means is comprised of:

(a) a flexible cable having two ends for accepting tighteners;

(b) a pair of tighteners for attaching to the ends of the cable; and (c) the blade carrying member defining at least two openings spaced apart from one another for accepting the cable therethrough and which are positioned next to each other along an axis which is substantially perpendicular to the longitudinal axis of the handle when the blade carrying member is attached to the broom, one opening located on each side of the handle;

so that when the handle is mounted to the head and the blade carrying member is positioned for attachment to the broom, the cable can be successively passed through the openings and about the head and the tighteners can be attached to the ends of the cable and tightened in order to secure the cable about the head and restrict the movement of the scraper device relative to the handle.

28. The scraper device as claimed in claim 27 wherein the blade carrying member defines two pairs of openings spaced apart from another and positioned such that when the handle is mounted to the head and the blade carrying member is positioned for attachment to the broom, one pair of openings is located adjacent to the head on each side of the handle.

29. The scraper device as claimed in claim 28 wherein the ends of the cable are threaded for accepting the tighteners and the tighteners are threaded for attaching to the ends of the cable.

30. The scraper device as claimed in claim 1 wherein the first bracing means is oriented so that the first bracing means is not parallel to the major axis of the head when the blade carrying member is attached to the broom.

31. The scraper device as claimed in claim 30 wherein the first bracing means is comprised of a pair of bracing members depending from the lower surface of the blade carrying member and integral with the blade carrying member, said first bracing means abutting against the head when the scraper device is attached to the broom without having to be fastened to the broom at the points of abutment against the head, to support the handle from the stresses which tend to break the handle at the point where it is mounted to the head.

* * * * *